US006000954A

United States Patent [19]

Medina et al.

[11] Patent Number: 6,000,954

[45] Date of Patent: Dec. 14, 1999

[54] TWO PIECE PIN CONNECTOR

[75] Inventors: Raul Medina; John J. Daly, both of Chicago, Ill.

[73] Assignee: Methode Electronics, Inc., Chicago, Ill.

[21] Appl. No.: 09/060,628

[22] Filed: Apr. 15, 1998

[51] Int. Cl.[6] ..... H01R 9/09

[52] U.S. Cl. ..... 439/79; 439/607

[58] Field of Search ..... 439/79, 328, 891

[56] References Cited

U.S. PATENT DOCUMENTS

| | | | |
|---|---|---|---|
| 4,243,289 | 1/1981 | Kozel | 339/126 RS |
| 4,607,899 | 8/1986 | Romine et al. | 339/19 |
| 4,678,250 | 7/1987 | Romine et al. | 439/83 |
| 4,776,807 | 10/1988 | Triner et al. | 439/82 |
| 4,857,002 | 8/1989 | Jensen et al. | 439/76 |
| 4,954,089 | 9/1990 | Jensen et al. | 439/76 |
| 5,387,115 | 2/1995 | Kozel et al. | 439/157 |
| 5,529,338 | 6/1996 | Thompson | 280/741 |
| 5,586,008 | 12/1996 | Kozel et al. | 361/743 |
| 5,688,146 | 11/1997 | McGinley et al. | 439/637 |
| 5,709,556 | 1/1998 | Tan et al. | 439/79 |
| 5,755,586 | 5/1998 | Knighton et al. | 439/328 |

*Primary Examiner*—Michael L. Gellner
*Assistant Examiner*—Antoine Ngandjui
*Attorney, Agent, or Firm*—Karl D. Kovach; David L. Newman

[57] ABSTRACT

The invention provides for an apparatus comprising a pin connector, and a method for assembling the pin connector, where the pin connector comprises a unitary insulator and housing, and a plurality of contact holes that extend between a front and back face of the insulator to receive contacts known in the art. The insulator may also contains an intermediate PCB slot that opens from the back face of the insulator and receives a PCB inserted therein. The unitary housing has a front and back end, where the back end receives the insulator from the front face, and the front end contains an open area that accesses the insulator to another connector mated therein. The invention may also incorporate a key element in the intermediate PCB slot that engages a matching notch on an edge of the PCB. The housing and insulator may include aligning fastener holes that receive fasteners shared by the components of the connector. The connector may also include one or more alignment ribs that extend from the back end forward along an interior side of the top segment of the housing. The pin connector may be assembled by inserting contacts into the front face of the insulator and inserting the insulator in the back end of the housing.

26 Claims, 10 Drawing Sheets

TWO PIECE PIN CONNECTOR

This invention pertains to pin connectors, and more specifically pin connectors that interconnect printed circuit boards.

BACKGROUND OF THE INVENTION

Pin connectors provide for data transfer between devices in technologies such as computer peripheral devices, data processing, and telecommunication equipment. These diverse applications require pin connectors to incorporate parameters in reference to the particular application. Such parameters include bit width, transmission speeds, dimension of associated devices, and other mechanical features that enable the pin connector to serve its particular function.

In some particular systems, pin connectors may comprise sub-components on systems transferring more complex and diverse data, including Local Area Networks (LANS) and Shared Resource Computing systems that utilize Gigabit Link Modules (GLM) for interfacing optical data with computer host system. GLMs receive serial data from optical devices and deserialize the data with circuits contained on a PCB. The pin connector mates with and transfers deserialized data to an opposing connector attached to a host computer. Data transfer devices such as GLM's exemplify instances where pin connectors are preferably mounted directly to a printed circuit board (PCB) to conserve space and reduce conductive transmission length. The structure of the connector may also be defined in part by the polarizing structure employed with the connector. For GLMs, the connector may be a 9 pin D-SUB connector known in the art that accesses the PCB to an associated mating connector employing the same polarizing structure. In the context of a GLM, the 9 pin connector may connect and transmit bit data to the host computer from a PCB that deserializes data inputted from an optical serial data sub-component. While the following disclosure specifically references a 9 pin connector for GLMs, it should be apparent to one skilled in the art that the shortcomings of the prior art discussed herein are equally applicable to a pin connector in general, and more specifically to pin connectors that mounts directly to any PCB or similar structure.

In general, current generation pin connectors employ designs that are inefficient to manufacture and assemble. Typically, pin connectors known in the art employ an insulator inserted within a housing that retains contacts to electrically contact the associated PCB. The contacts are accessible through a front face of the insulator such that an associated connector may mate thereto and electrically interconnect with the PCB. The insulators may include male contacts that extend as pins from the front end of the insulator to be received by female contacts of an associated connector mated thereto. Likewise, female contacts may alternatively be employed within the insulator to provide single or double wiped apertures that receive male contacts from the associated male connector.

With connectors in general, and D-SUB connectors in particular, the general construction employs a multi-piece insulator and housing. The insulator is assembled prior to insertion into the housing and may require fastening means to separately secure the insulator pieces together. Similarly the housing typically comprises two or more pieces, such as a face plate and a mounting structure, that are also separately secured together through mechanical fasteners. Once the insulator and housing are individually assembled, additional fastening means are necessary to secure the insulator and housing together. Once assembled, the pin connector as a whole may be attached to the PCB through fasteners and fastening means known in the art. As a result of the multi-piece construction of the insulator and the housing, several steps are required to assemble a connector for any particular application. In the context of GLMs, the assembly of the known D-SUB connectors with the PCB in the aforementioned manner adds substantial cost and labor expense to the overall module. It is therefore desirable to reduce the number of steps required to assemble a pin connector for any particular application, including applications employing the pin connector in engagement with the PCB of a GLM.

The aforementioned pin connectors, including D-SUB connectors for use with GLM devices, have several other shortcomings as well. The prior art D-SUB connectors may include an intermediate PCB slot that engages the PCB edgewise. In such instances, the particular position and orientation of the insulator is significant in assembling the pin connector to the PCB, as the contacts extending from the insulator must contact specific contact points on the PCB. However, the prior art connectors lack inherent features that would otherwise prevent common assembly errors such as attaching the connector with the PCB upside down, or with the contacts mis-aligned to the corresponding contact point on the PCB.

Furthermore, known pin connectors require an inefficient multi-step process for loading contacts into the insulator. Under the prior art, female contacts must be front-loaded tail first into a back portion of the insulator, with a tulip portion of the contacts extending freely from the front end of the back portion. The back portion of the insulator must then be back-loaded with a front portion of the insulator, such that the tulip portions are loaded through the back end of the front portion comprising the insulator. In addition, prior art insulators lacked a sufficient degree of precision molding to securely retain the female contacts in easily removeable fashion. As such, inserting the contacts individually into the insulator is a tedious process requiring several steps.

Moreover, the D-SUB connectors of the known art utilize inefficient and clumsy fastening means for securing the insulator within the housing. For instance, the insulator may incorporate molded plastic protrusions that must align and engage receivers of the housing to secure the insulator thereto. The housing may also include metal protrusions that align and engage ridges or other receivers of the insulator. For mass production, aligning the respective protrusions and receivers of the insulators and housings is very time consuming and laborious.

With these limitations in mind, it is an object of the invention to provide a two piece pin connector, including a unitary insulator and housing, that may be easily assembled and employed.

It is still another object of the invention to provide a pin connector that allows the contacts to be inserted into the insulator in one step, and allows for the insulator with contacts contained therein to be inserted into the housing in another step.

Still another object of the invention is to provide a housing and insulator that receive a PCB at an intermediate PCB slot, and share a set of fasteners that secure the housing, insulator, and PCB to one another.

Still another object of the invention is to provide a unitary housing including alignment ribs that frictionally retain the insulator inserted therein.

Still another object of the invention is to provide an insulator with contact holes that are precision molded and shaped to easily receives and frictionally retain contacts inserted therein.

And still another object of the invention is to provide an insulator that is shaped to be frictionally secured within a corresponding housing.

SUMMARY OF THE INVENTION

In accordance with the objects of the invention, one embodiment of the invention provides for a pin connector having a unitary insulator and housing. The pin connector includes a plurality of contact holes that extend between a front and back face of the insulator. The contact holes receive contacts known in the art, and may be molded to accommodate the specific shape of a dual-wiped contact. The insulator also contains an intermediate PCB slot that opens from the back face of the insulator and receives a PCB inserted therein. The unitary housing has a front and back end, where the back end receives the insulator from the front face, and the front end contains an open area that accesses the insulator to another connector mated therein.

This embodiment may also incorporate a key element in the intermediate PCB slot that engages a matching notch on an edge of the PCB, thereby enabling the contacts to precisely engage the PCB. In this way, the key element precludes the connector of this embodiment from misaligning the contacts with the appropriate contact points on the PCB during the assembly process.

The housing also has a top cover that extends between the front and back end and contains one or more exterior fastener holes. The insulator contains a top and bottom surface that extends between the front and back face, and at least one top and/or bottom fastener hole that extends through the insulator from the top and/or bottom surface to the intermediate PCB. The alignment of the fastener holes with the PCB enable one or more mechanical fasteners to be inserted into the aligned fastener holes to secure the entire assembly and components therein. Thus, the preferred embodiment allows for the connector to be easily assembled with the PCB, using fasteners that are shared between the components and the PCB.

Another feature incorporated in this preferred embodiment includes one or more alignment ribs that extend from the back end forward along an interior side of the top cover of the housing. The alignment ribs protrude towards the insulator and frictionally retain the insulator within the housing.

The invention may also be practiced as a method for assembling a pin connector. The method of this invention includes loading the plurality of contacts tail-first into the plurality of contact holes in the front face of the unitary insulator. Assembly of the pin connector further requires extending the contacts through the insulator beyond the back face, and loading the front face of the insulator into the back end of the housing. The next steps requires inserting the PCB into the intermediate PCB slot of the housing, and also inserting at least one fastener through the housing, insulator and PCB, where the fastener is inserted from the top cover of the housing through the bottom surface of the insulator. Once assembled, the method requires electrically contacting the contacts extending from the back face of the insulator with the PCB. It should be apparent to one skilled in the art that this method is less laborious and requires fewer steps than other known methods for assembling pin connectors.

The specific embodiments described herein may encompass a D-SUB connector. Moreover, the invention may preferably be practiced as a component in a GLM or similar device.

DETAILED DESCRIPTION OF THE PRESENTLY PREFERRED EMBODIMENTS

Figure 1:
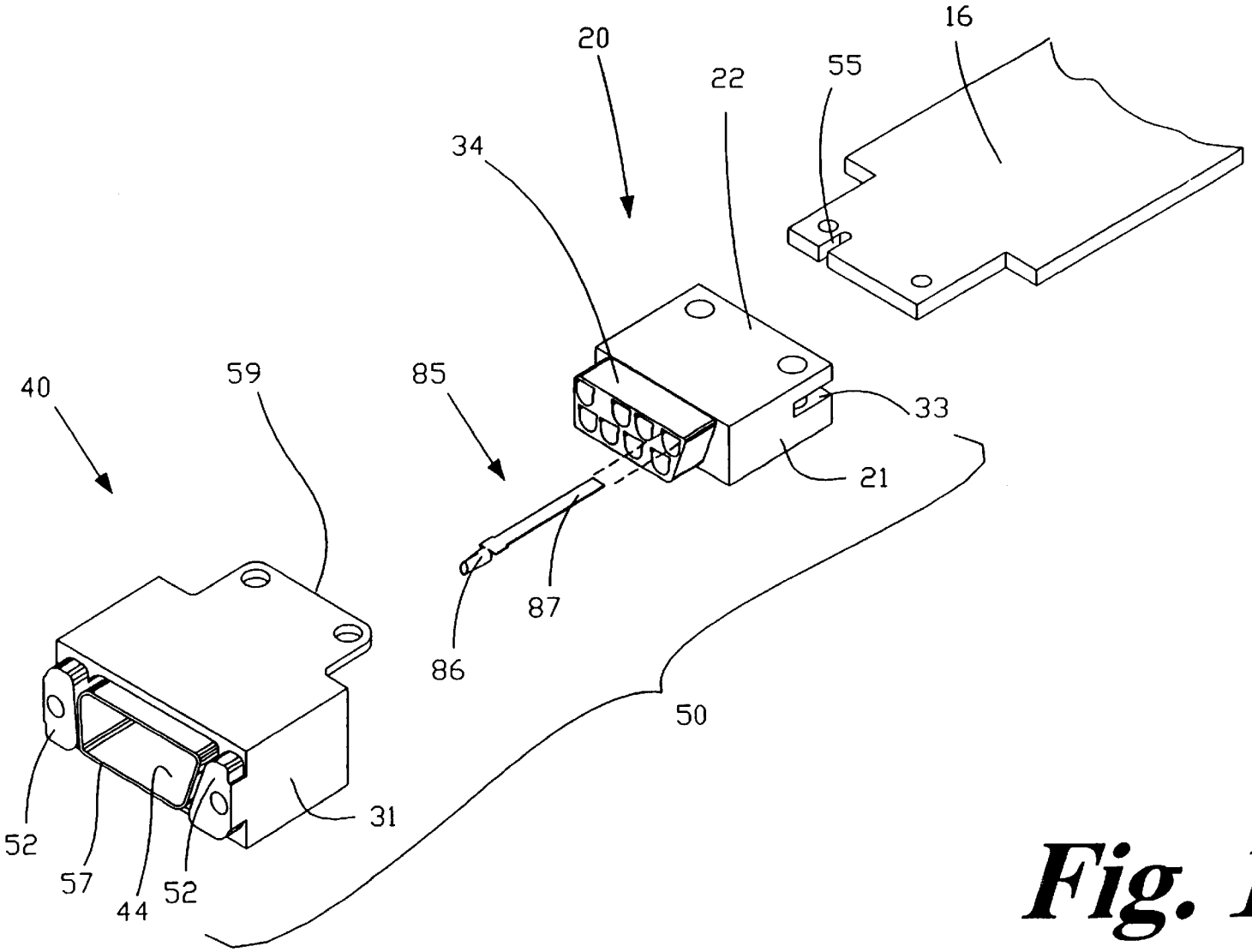
FIG. 1 is an exploded isometric view of the pin connector of this invention.

Now turning to the drawings, FIG. 1 is an exploded view of a two piece pin connector 50 of this invention that electrically contacts a printed circuit board (PCB) with an opposing connector (not shown). The pin connector 50 has an insulator 20 that inserts within a housing 40. In this embodiment, the insulator 20 and the housing 40 are both unitary components. The insulator is preferably molded plastic and contains a plurality of contacts 85 which engage a PCB 16 at selected contact points. Preferably, the contacts 85 contain a tulip portion 86 and a flat tail 87. As will be described elsewhere in this disclosure, the PCB 16 used with this invention includes a notch 55 that mates with the insulator 20. The housing 40 is preferably die-cast metal and may fasten with a opposing connector (not shown) in a manner that allows the opposing connector to engage the contacts 85 contained in the insulator 20.

While the principles of this application are applicable to connectors in general, the embodiments described herein are specifically referenced for GLMs that interconnect with a host computer. As such, the PCB 16 depicted in FIG. 1 is dimensioned to fit in a GLM package and engage an end of the PCB opposing the pin connector 50. Likewise, the preferred embodiment is described as a 9 pin D-SUB connector for employment with the GLM. It should be noted that 9 pin D-SUB connectors for GLM's provide for 9 pins, but as illustrated in this application, may actually employ 8 or fewer pins.

With further reference to FIG. 1, both the insulator 20 and the housing 40 may be oriented relative to a front and back, where the front designates the region in proximity to the opposing connector, and the back designates the region in proximity to the PCB 16. In this orientation, the housing 40 contains a front end 57 with an open area 44 for receiving the opposing connector, and a back end 59 that is the entrance for the insulator 20. The insulator 20 has a front portion 34 that contains the front face 47, and a back portion 22 that integrally extends from the front portion 34 and contains a back face 49 (shown in FIG. 10) abutting the PCB 16 and opposing the front face 47. Preferably, the front portion 34 has a polarizing D-shape in accordance with the D-SUB connector described herein. The insulator 20 also has a first side wall 21 and second side wall 22 (shown in FIG. 3) that oppose one another and are received within the respective first side wall 31 and second side wall 32 (shown in FIG. 3) of the housing 40. An intermediate PCB slot 33 extends the width of the back portion 22 between the first and second side wall of the insulator 20. The intermediate PCB slot 33 opens at the back face 49 to engage an edge of the PCB 16.

As illustrated with FIG. 1 and the other drawings, the preferred embodiment employed with the GLM is a female connector that has an insulator 20 with a front portion 34 having a D-shaped polarizing shape that mates with other similarly dimensioned connectors. In general, the D-SUB configuration contains a quadrahedron cross-section with opposing parallel sides, where one pair has one length greater than the opposing length. This particular cross-section serves to polarize the pin connector 50 for engagement with other opposing connectors of the same polarized construction.

Figure 2:
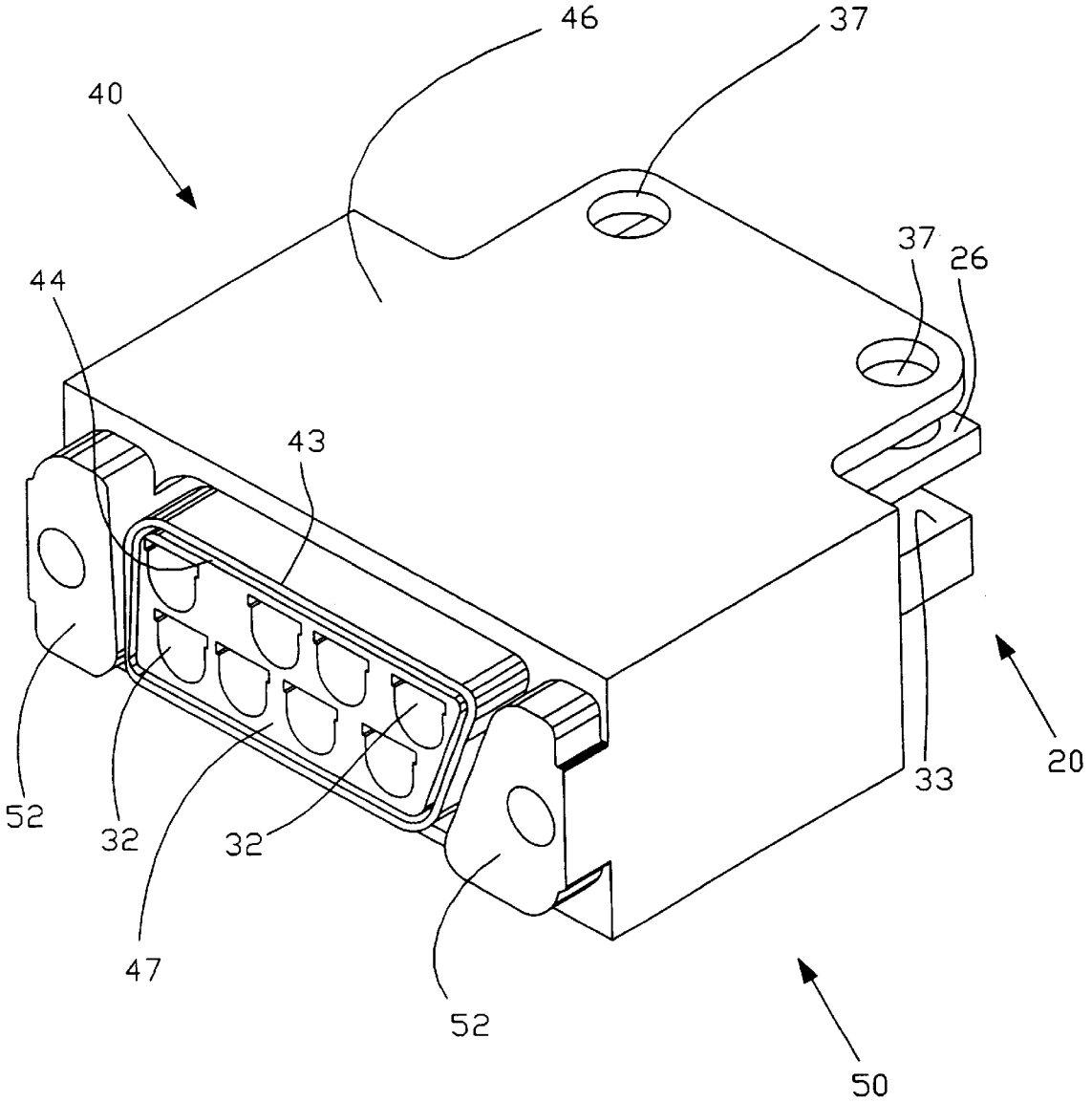
FIG. 2 is a top isometric view of the pin connector showing the insulator inserted within the housing.

FIG. 2 shows a top isometric view of the insulator 20 inserted within the housing 40, with the front face 47 of the insulator 20 engaging the open area 44 of the housing 40. A rim 43 circumvents the open area 44 and the insulator 20 contained therein. The insulator 20 contains a plurality of contact holes 32 that may accommodate contacts 85 (shown in FIG. 1). The contacts 85 (FIG. 1) have tulip portions 86 that form female receivers for mating with male contacts of the opposing connector. As will be discussed in greater detail, the preferred embodiment is molded to precisely receive the tulip and tail portion 86 and 87 of the contacts 85. Once the pin connector 50 is assembled and mounted to the PCB 16 (shown in FIG. 1), the opposing connector may then be mounted over the rim 43 to engage the contacts 85 retained within the insulator 20. The opposing connector may be secured to the pin connector 50 by mechanical fasteners (not shown) inserted into the threaded apertures contained within an opposing pair of stand-offs 52. In the fastened position, the opposing connector may extend male contacts into the tulip portions of the female contacts contained within the individual contact holes 32. Further details on how the respective contacts 85 engage contact holes 32 and establish electrical contacts between the PCB 16 and the opposing connector will also be provided below.

With further reference to FIG. 2, the insulator 20 is shown including a top surface 26 that provides a pair of opposing top fastener holes 27 (shown in full by FIG. 4) that align vertically and extend to the intermediate PCB slot 33. The housing provides a top and bottom cover 46 and 48 (shown in FIG. 3) that extend over the insulator 20. Preferably, the top cover 46 of the housing 40 contains a pair of opposing external fastener holes 37 that align with the top fastener hole 27 of the insulator 20.

Figure 3:
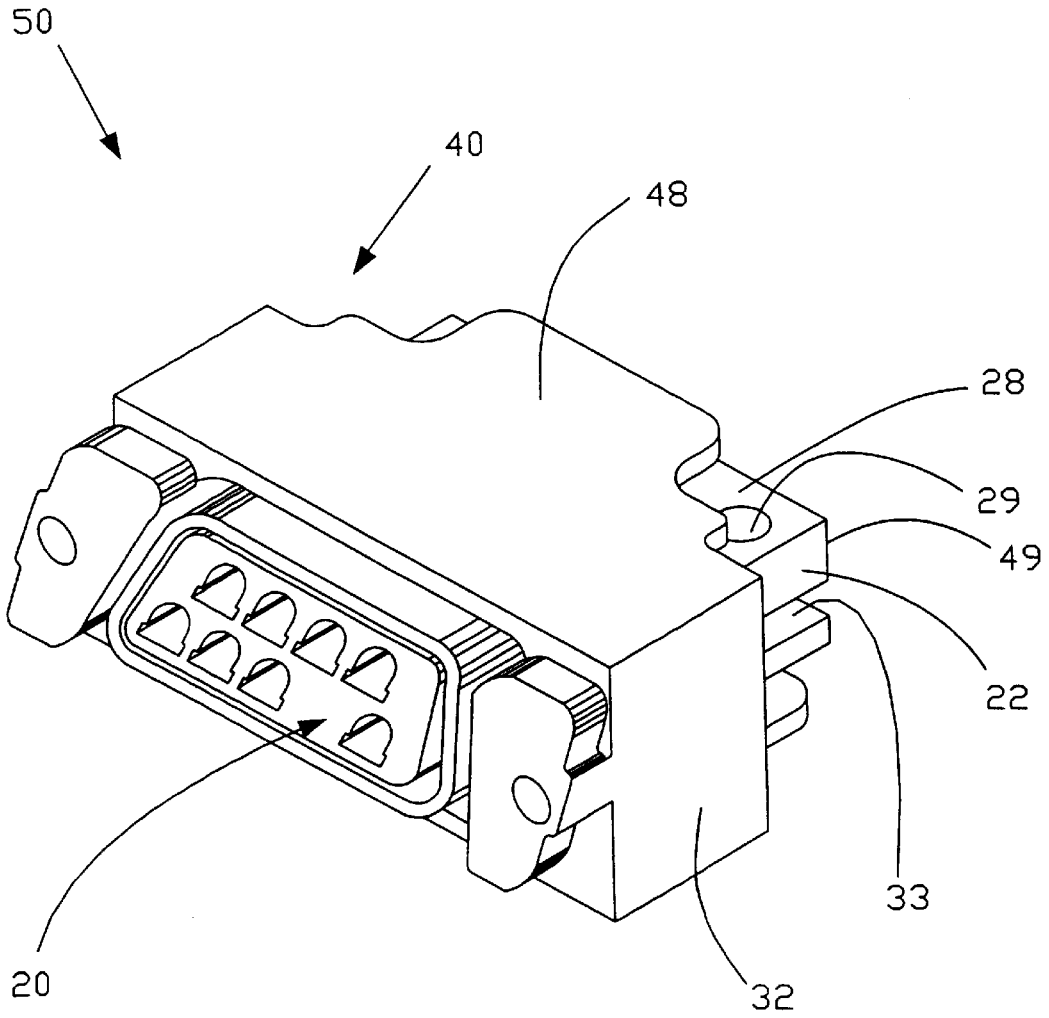
FIG. 3 is a bottom isometric view of the pin connector showing the insulator inserted within the housing.

With reference to the bottom isometric view of the assembled pin connector 50 in FIG. 3, the bottom cover 48 of the housing 40 covers a bottom surface 28 of the insulator 20. The insulator 20 has side walls 21 (shown in FIG. I) and 22 that reside adjacent to the side walls 31 (FIG. 1) and 32 of the housing 40. The insulator 20 contains bottom fastener holes 29 (shown in part by FIG. 4) at opposing comers of the bottom surface 28 that extend through the insulator 20 to the intermediate PCB slot 33. The bottom segment 48 has a contoured ledge that extends to the rear face 49 of the insulator 20 while exposing the bottom vertical holes 29.

Figure 4:
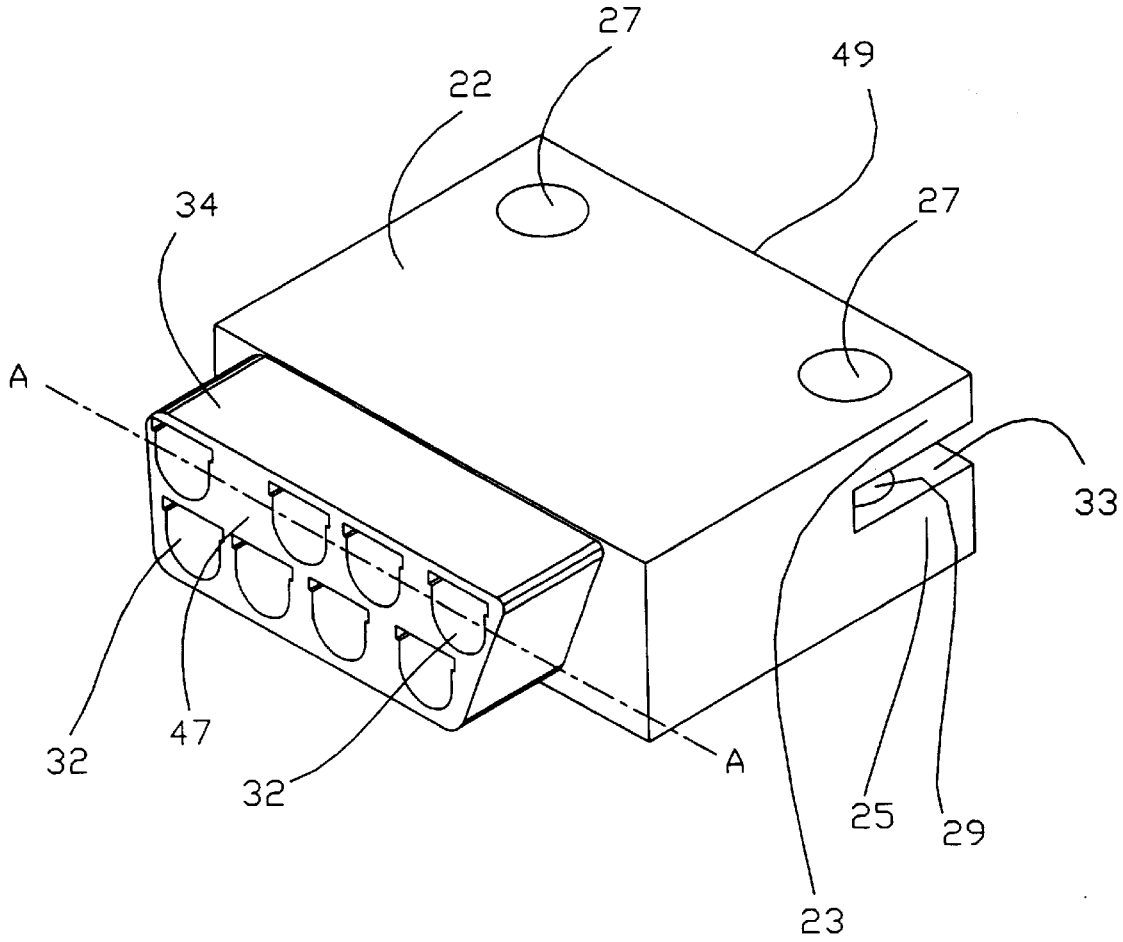
FIG. 4 is a top isometric view of the insulator used with this invention.

With reference to FIG. 4, the insulator 20 is shown as a unitary component comprising the back portion 22 and the front portion 34. A plurality of contact holes 32 are provided in the insulator 20 during the molding process to individually receive contacts 85 (shown in FIG. 1) that electrically interconnect the opposing connector and the PCB 16 (shown in FIG. 1). Accordingly, the molding process should provide for the plurality of contact holes 32 to extend length-wise from the front face 47 to the back face 49. FIG. 4 shows that the contact holes 32 are arranged in a top and bottom row to accommodate the D-SUB alignment of the preferred embodiment. The back portion 22 includes a top and bottom segment 23 and 25 respectively, intersected by a intermediate PCB slot 33, where the top segment 23 is thinner than the bottom segment 25. The intermediate PCB slot 33 may engage the PCB 16 when mounted thereto. Once assembled, each fastener hole 27 and 29 of the insulator 20 aligns with the corresponding fastener hole 37 (FIG. 2) of the housing 40. The manner in which fasteners secure the housing 40, insulator 20, and the entire pin connector 50 as a whole to the PCB 16 via the fastener holes 37, 27 and 29 will be discussed in greater detail below.

Figure 5:
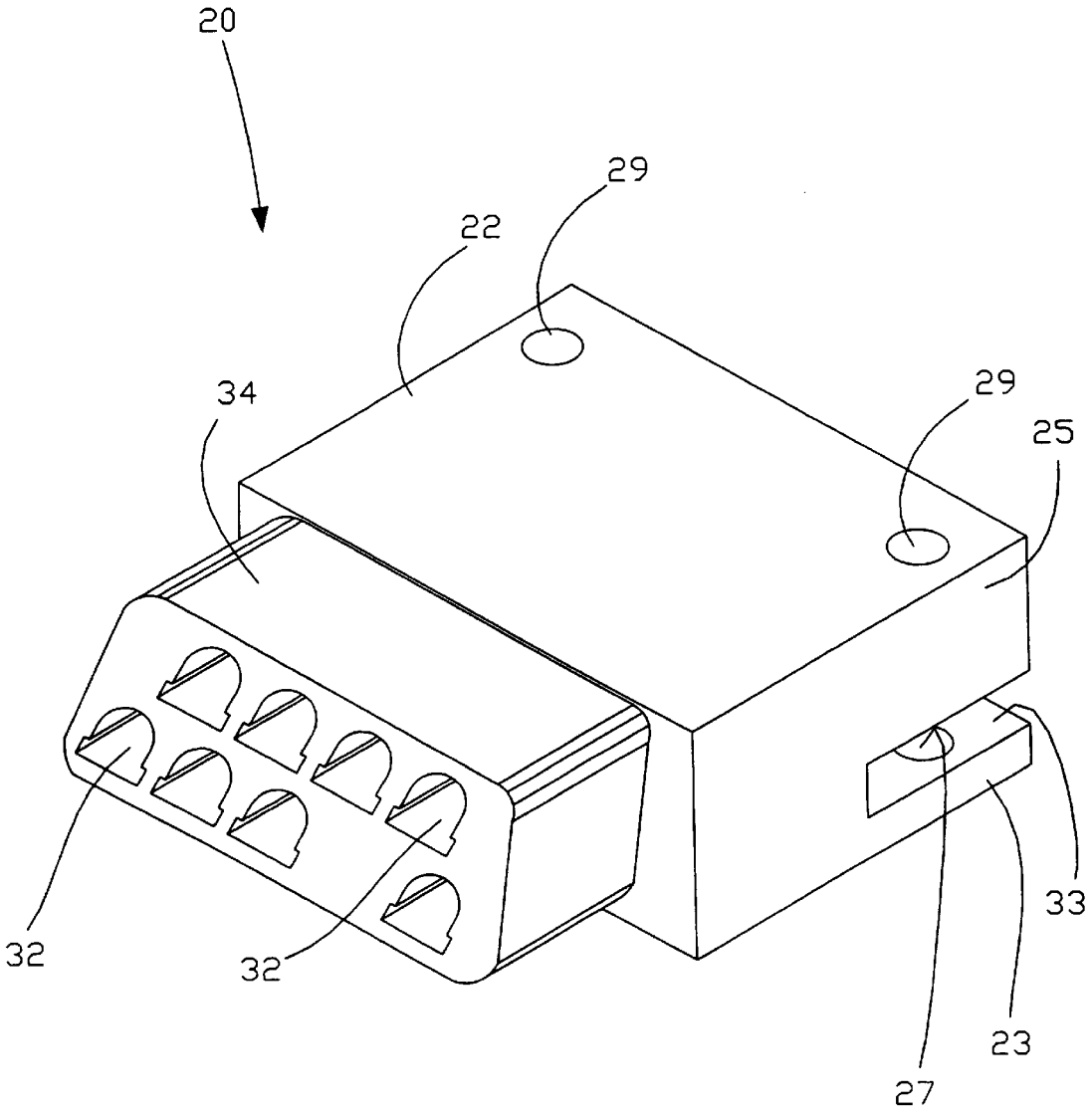
FIG. 5 is a bottom isometric view of the insulator used in this invention.

FIG. 5 is an isometric bottom view showing in greater detail the configuration of the insulator 20, including the D-SUB front portion 34, back portion 22 and contact holes 32 contained therein. As previously mentioned, the back portion 22 contains the bottom fastener holes 29 that extend through the bottom segment 25 and are accessible from the housing 40 (shown in FIG. 2). Likewise, the top segment 23 contains the top fastener holes 27 that align with the bottom fastener holes 29 and are accessible from the housing 40 (FIG. 2) via external fastener holes 37 (FIG. 2). The intermediate PCB slot 33 intersects the insulator 20 to define the top and bottom segment 23 and 25, and receives the PCB 16 (shown in FIG. 1) therein. Preferably, the pin connector 50 (shown assembled in FIG. 1) is positioned and secured to the PCB 16 via intermediate PCB slot 33 by self-tapping screws (not shown) that individually insert through the external fastener holes 37 of the housing 40, and through the top and bottom fastener holes 27 and 29 of the insulator 20. In this way, the shared fasteners inserted through the fastener holes 37, 27 and 29 secure the insulator 20 and housing 40 together, while attaching the entire pin connector 50 as a whole to the PCB 16.

It will be appreciated that the described configuration of the preferred embodiment drastically reduces assembly time and provides a more reliable means for securing the housing 40, insulator 20, and PCB 16 together. In contrast, assembling the connector of the prior art requires separately assembling the insulator, separate fastening means to assemble the housing, still more fasteners to secure the insulator within the housing, and still additional fasteners to secure the assembled connector to the PCB. Moreover, the corresponding fastening means of the prior art orient along multiple axis and surfaces to retain the multiple components of the housing 40 and insulator 20, thereby requiring rotation of the connector components and/or fastening tools during the assembly process.

Figure 6:
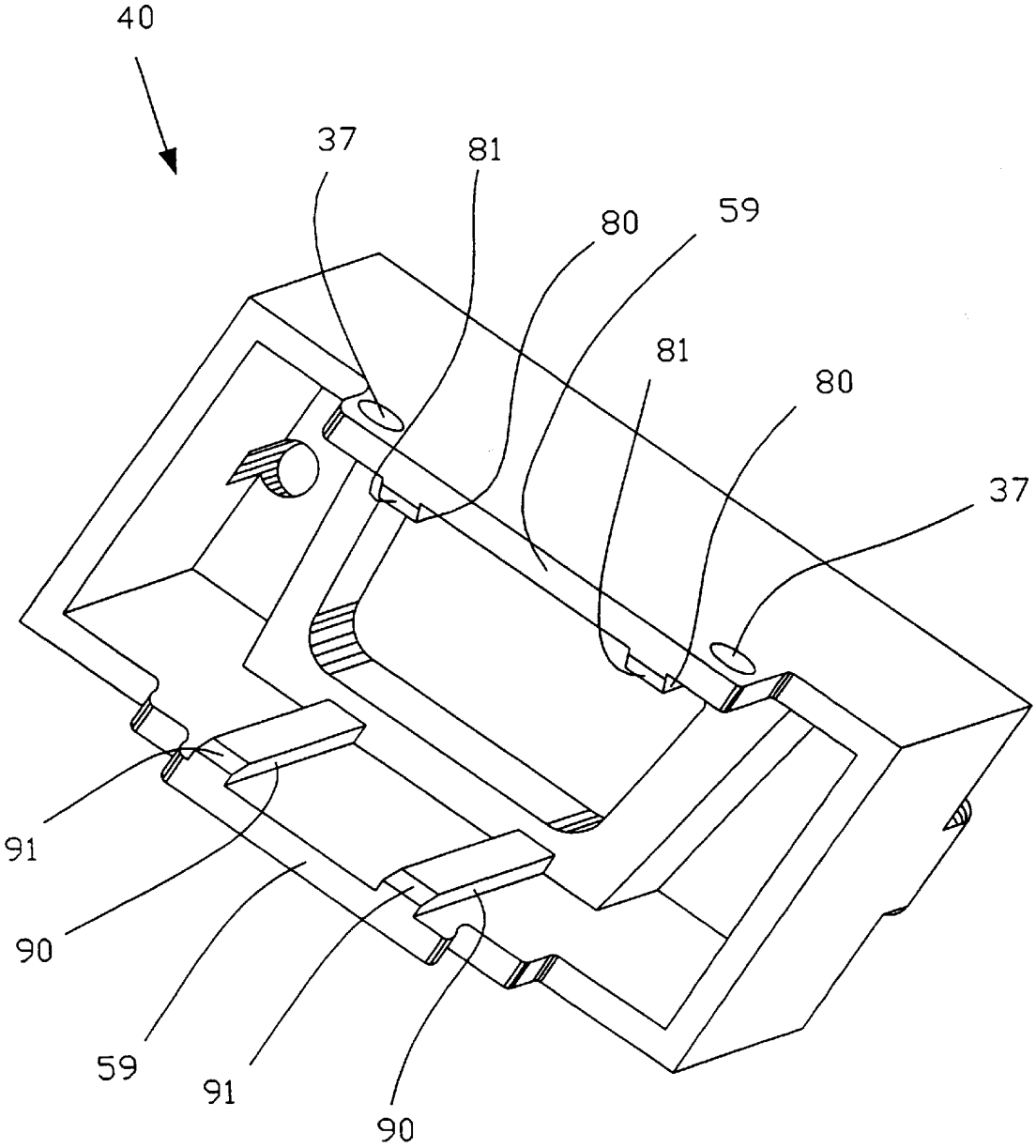
FIG. 6 is a back isometric view of the housing used with this invention.

With reference to FIG. 6, an isometric view of the back end 59 of the housing 40 is shown containing opposing top and bottom pairs of alignment ribs 80 and 90. Each alignment rib contains a top and bottom wedged end-piece 81 and 91 that frictionally receives the insulator 20 upon its insertion. The wedged end-pieces 81 and 91 ensure that the insulator 20 is securely received within the housing 40. As previously described in detail, fasteners such as self-tapping screws may also insert through the external fastener openings 37 of the housing 40 and secure the insulator 20 via top and bottom fastener openings 27 and 29.

Figure 7:
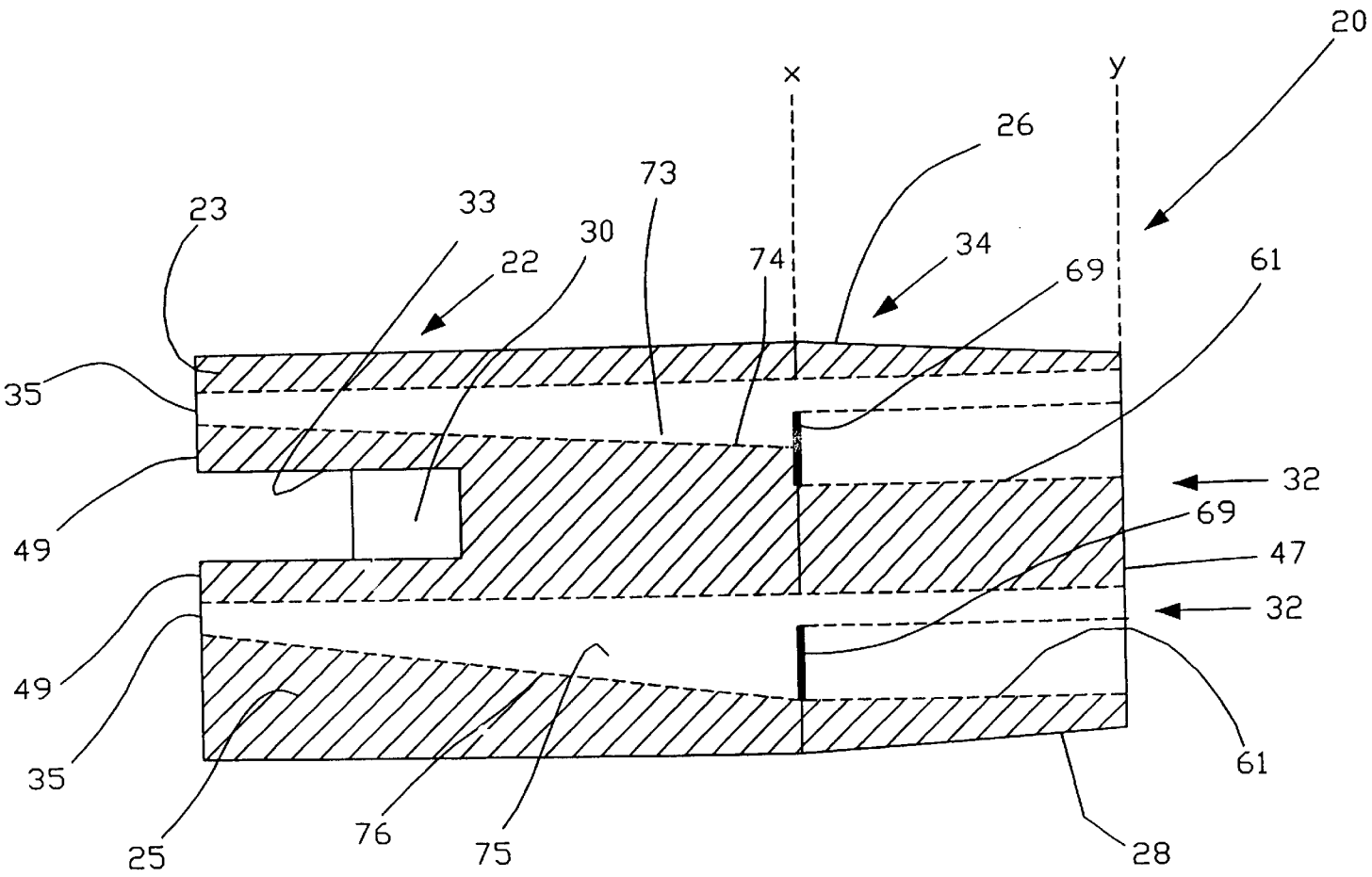
FIG. 7 is a side view of the insulator showing the contact holes with hidden lines.

FIG. 7 is an illustrative side view of the insulator 20 with the contact holes 32 contained therein shown in phantom. The top and bottom rows of the contact holes 32 extend across the top segment 23 and bottom segment 25 respectively. In the preferred embodiment, the contact holes 32 are shaped to accommodate female contacts 85 (shown in FIG. 1) having dual wipes in the tulip portion 86 integrally joined with an elongated flat tail 87. Accordingly, each contact hole 32 of the preferred embodiment is shown comprising a tulip channel 61 within the front portion 34. Each tulip channels 61 is bordered within the insulator by a semi-annular shoulder 69 (shown in bold for illustrative purposes). In this configuration, the tulip channels 61 may receive the dual wiped ends of the respective contacts and provide for the flat tails to extend backward therefrom through the remainder of the contact holes 32. To this end, each of the tulip channels 61 abuts a top or bottom ramped channel 73 or 75 at the shoulder 69. The top and bottom ramped channels 73 and 75 taper one-dimensionally into a contact slit 35 that receives the respective flat tail 87 of the contacts. The top and bottom ramped channels 73 and 75 extend the length of the back portion 22 to engage and frictionally retain the individual contacts 85 at the back face 49. With respect to the top rows of the contact holes 32, the top ramped channels 73 have a region of greatest cross-sectional area abutting the shoulders 69, and align with the tulip channel 61 in a manner that accommodates the flat tail of the contact inserted into the contact hole 32. A top floor 74 causes the ramped channels 73 to taper upward from the shoulder 69, such that the ramped channels 73 form the top row of contact slits 35 at the back face 49. The top and bottom ramped channels 73 and 75 are nearly identical, except that the bottom ramped channel 75 have a smaller maximum cross-sectioned area that abuts the shoulder 69. In similar fashion to the top row of contact holes 32, a bottom floor 76, having a more gradual slope than the top floor 74, causes the bottom ramped channels 75 to taper upward and form a bottom row of contact slits 35 at the back face 49.

The high degree of precision molding used to form the insulator 20 allows for the contacts 85 (shown in FIG. 1) to be sub-flushed 0.020" from the front face 47. In contrast, the prior art sub-flushes the contacts 0.05" or more. The proximity of the contact 85 to the front face 47 is an improvement over the prior art in that it enhances the electrical connection between the connector 50 and the opposing connector.

With further reference to FIG. 7, another novel feature of the preferred embodiment is that the intermediate PCB slot 33 contains a key element 30 that mates with a corresponding notch 55 (shown in FIG. 1) on the PCB. The key element may be situated anywhere within the intermediate PCB slot 33 so long as the orientation and position of the key element 30 is premeditated to correspond with the notch 55. Therefore, the key element 30 ensures that the PCB enters and engages the intermediate PCB slot 33 only when the insulator 20 and PCB 16 are properly aligned. In this way, the contacts 85 (shown in FIG. 1) extending from the insulator 20 contact the desired contact points of the PCB.

FIG. 7 also shows the front portion 34 of the insulator 20 having a gradually sloped top and bottom surface 26 and 28 that extend towards the housing 40 from the front face 47 of the insulator 20. The gradual slope of the top and bottom surface 26 and 28 is exaggeratedly referenced by lines x and y that show the orientation and length of the slope. This feature further enables the insulator 20 to frictionally secure within the housing 40 upon its insertion.

Figure 8:
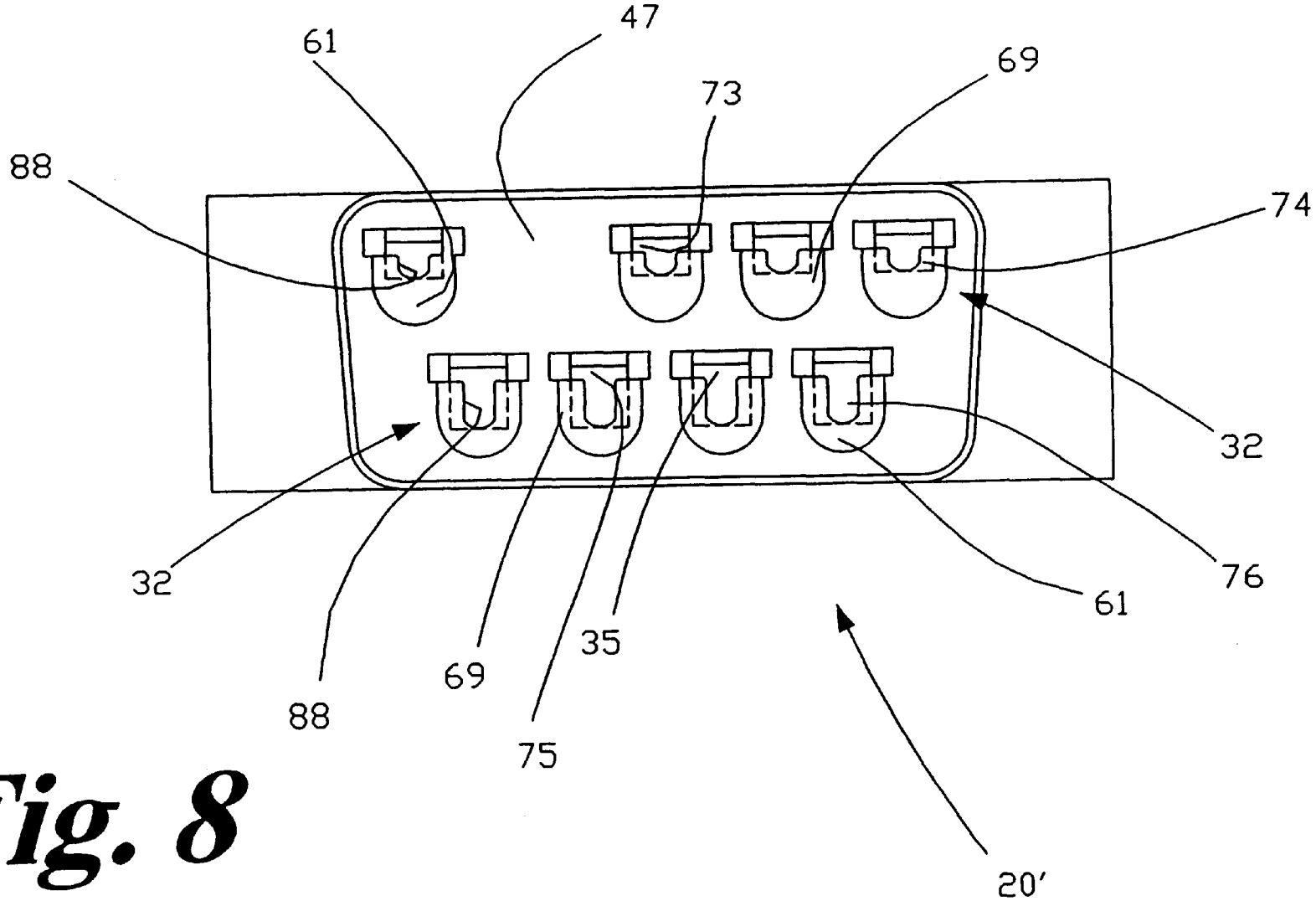
FIG. 8 is a front view of an alternative preferred insulator illustrating features of the contact holes.

FIG. 8 is a front view of an alternative insulator 20' inserted within the housing 40 and containing contact holes 32 molded therein. FIG. 8 illustrates that the tulip channels 61 are bordered by the shoulders 69 and abut the respective top or bottom ramped channels 73 or 75. In FIG. 8, the shoulders 69 preferably contain an optional notch 88 that facilitates the molding and manufacturing of the insulator 20'. As FIG. 8 firer shows, the top row of contact holes 32 contain the top floor 74 that defines the top ramped channel 73. Likewise, the bottom row of contact holes 32 contain the bottom floor 76 that defines the bottom ramped channel 75. In this way, the contacts 85 (FIG. 1) may be inserted tail-first through the contact holes 32, such that the tulip channel 61 retains the tulip portion 86 of the contacts, and the flat tail 87 of the contacts snugly extends from the contact slit 35 to electrically contact the PCB 16 (shown in FIG. 1). Thus, the preferred embodiment provides for contacts to be inserted through the front face 47 of the insulator 20' and extend therein to the PCB 16, where each contact 85 may be frictionally retained by the tulip channel 61 and respective ramped channel 73 or 75 of the respective contact hole 32.

Figure 9:
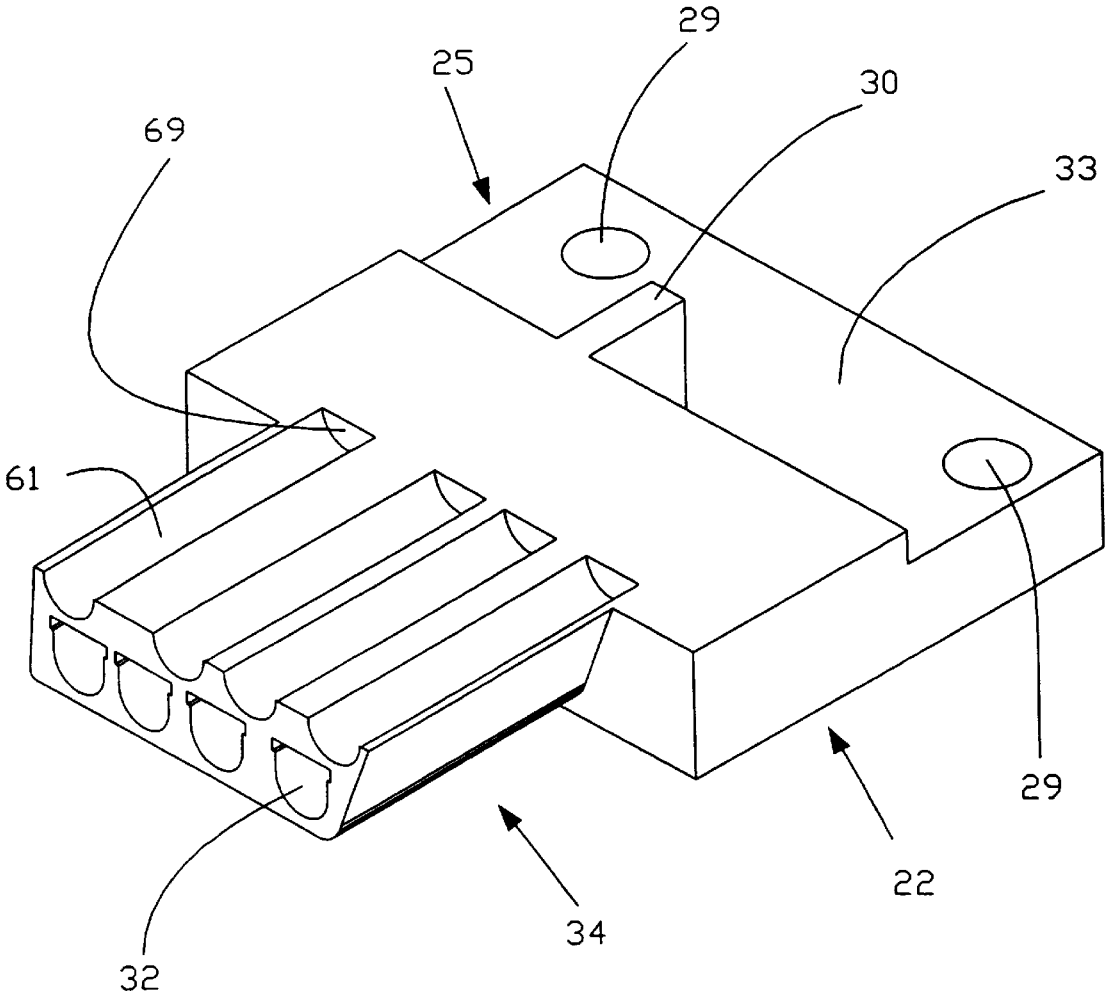
FIG. 9 is an isometric cut-away of the insulator along lines A—A shown in FIG. 4.

It should be apparent to one skilled in the art that while the contact holes 32 have been described in a manner consistent with engaging dual wiped contacts 85 (FIG. 1), single or alternative wiped contacts may similarly be provided for with slight modifications. More specifically, the geometry and dimensions of the respective components of the contact holes, including the tulip channel 61 and/or ramped channels 73 and 75 may be altered to accommodate the respective contacts. In either case, the contact holes 32 as described in this application are only one of many novel features that exist on the preferred embodiment FIG. 9 is an isometric cross-sectional view of the insulator 20 cut along line A—A of FIG. 4 that illustrates the interior of the insulator 20. Specifically, the tulip channels 61 of the contact holes 32 are shown to have contoured confines that abut shoulders 69. The intermediate PCB slot 33 aligns the top and bottom fastener holes 27 (shown in FIG. 4) and 29 in alignment with for receiving fasteners herein. As previously discussed, the intermediate PCB slot 33 also contains the key element 30 that protrudes from the front portion 34 and is bordered by the top and bottom segment 23 (shown in FIG. 4) and 25. The key element 30 engages the corresponding notch 55 (shown in FIG. 1) on the PCB 16 thereby enabling the pin connector 50 (FIG. 1) to be positioned with respect to the PCB 16. The particular location of the key element 30 is a design parameter that depends on the PCB 16 and connectors utilized. In this way, the key element 30 is another improvement of this embodiment that facilitates the attachment of the pin connector 50 with the PCB 16. In particular, the key element 30 positions the pin connector 50 such that the contacts 85 (FIG. 1) extending from the back face 49 of the insulator 20 precisely engage correct contact points on the PCB 16.

Figure 10:
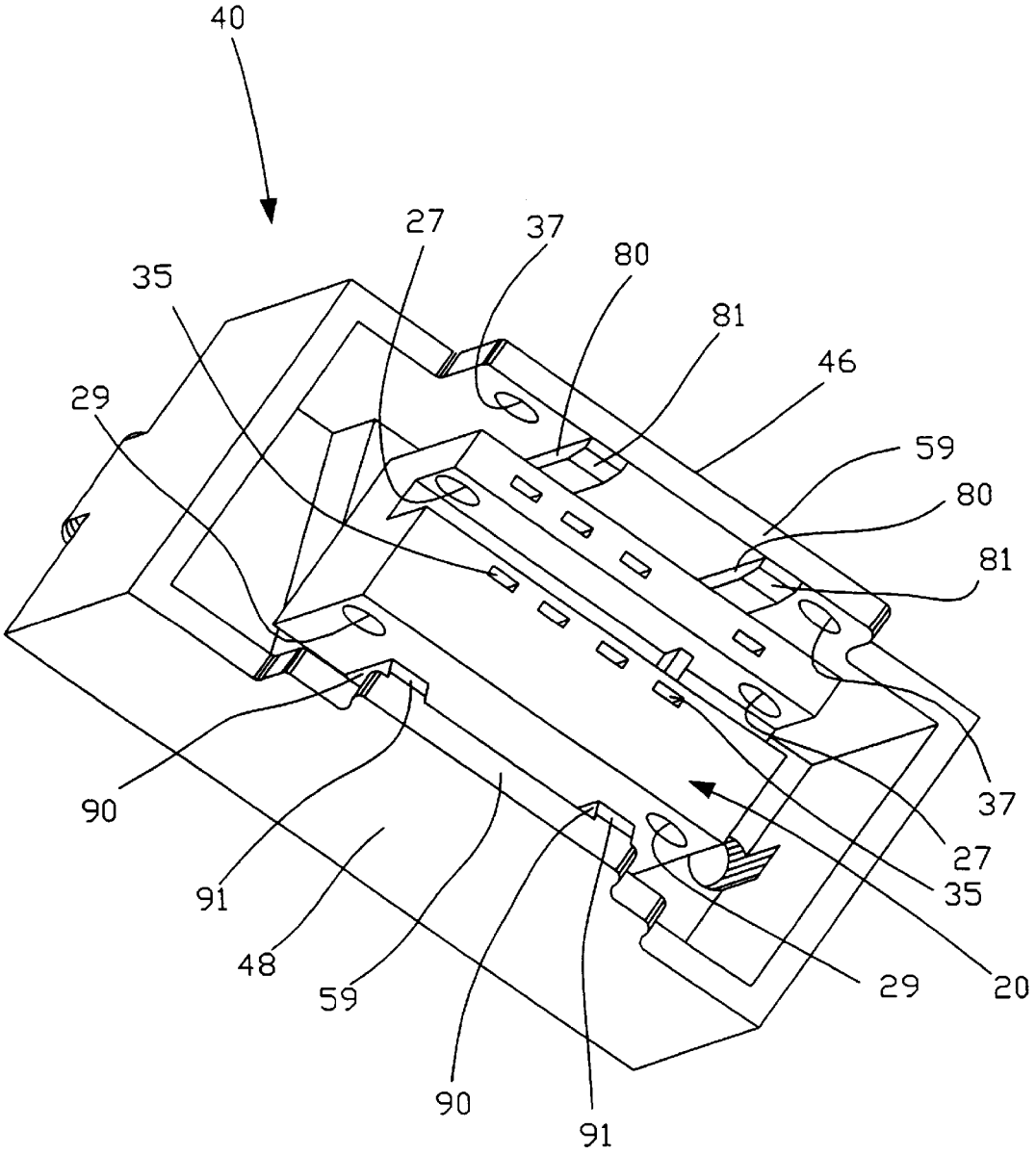
FIG. 10 is a isometric view of the back of the pin connector, with the insulator inserted within the housing.

FIG. 10 is an isometric back view that completes the depiction of the pin connector 50. As previously described in great detail, the housing 40 contains the top cover 46 with external fastener holes 37 that align over the top and bottom fastener holes 27 and 29 of the insulator 20. The top and bottom pairs of alignment ribs 80 and 90 extend from the back end 59 forward on the interior sides of the top and bottom cover 46 and 48. The alignment ribs 80 and 90 are shown containing respective wedge end-pieces 81 and 91 that frictionally retain the insulator 20 within the housing 40. The contact holes 32 appear as contact slits 35 that access the contact holes 32 on the back face 49. The insulator 20 also retains the key element 30 in the intermediate PCB slot 33 for positioning and engaging the pin connector 50 with the PCB 16 (not shown).

In summary, in view of FIGS. 1–10, it should be apparent that the preferred embodiment has several advantages over the known art. It will be appreciated that the construction of the pin connector 50, including incorporation of the unitary housing 40 and insulator 20, provide a secure and efficient means for loading contacts 85 into the pin connector SQ. In the preferred embodiment, contacts may be loaded tail-first through the front face 47 of the insulator 20 such that the tulip portion 86 of the contacts rest within the tulip channels 61, and the tail portions 87 extend through the back face 49 of the insulator 20. In this way, the contacts may be secured within the insulator 20 by the frictional forces on the contacts at the tulip channels 61 and at the top or bottom ramped channels 73 or 75. Once the contacts 85 are properly inserted, the insulator 20 may be loaded through the back end 59 of the housing 40. The top and bottom alignment ribs, and wedges 81 and 91 contained therein, create additional frictional forces that retain the insulator 20 within the housing 40. The pin connector 50 itself may be positioned along the PCB 16 by engaging the key element 30 with the corresponding notch 55 on the edge of the PCB 16. Once positioned, self-tapping screws may be inserted through the fastener holes 37, 27 and 29, such that the pin connector 50 is secured to the PCB 16. In the preferred embodiment, the self-tapping screws may easily be inserted through the top cover 46 of the housing 40 and sufficiently retain the pin connector 50 to the PCB 16.

It should be understood that various changes and modifications to the presently preferred embodiments described herein will be apparent to those skilled in the art Such changes and modifications may be made without departing from the spirit and scope of the present invention and without diminishing its attendant advantages. It is, therefore, that such changes and modifications be covered by the appended claims.

What is claimed is:

1. A pin connector comprising:

a unitary housing having a front and back end, the front end having an open area;

a unitary insulator having a front and back face, a plurality of contact holes extending between the front and back face, and an intermediate PCB slot open from the back face that is engageable with an edge of a PCB; and a key element in the intermediate PCB slot being engageable with a matching notch on the edge of the PCB, and wherein the insulator is contained within the housing, such that the front face is accessible through the open area to another connector.

2. The connector of claim 1 wherein:

said housing has a top cover integrally extending between the front and back end that contains at least one exterior fastener hole therein; and said insulator contains a top and bottom surface extending between the front and back face, wherein the top and bottom surface contain a respective top and bottom fastener hole that extend in alignment with the exterior fastener hole to the intermediate PCB slot.

3. The housing of claim 2 further comprising at least one alignment rib extending from the back end forward along an interior side of the top cover, and protruding to the insulator to frictionally retain the insulator within the housing.

4. The insulator of claim 3 further comprising a front portion and a back portion, the front portion extending backward from the front face, and the back portion extending forward from the back face, wherein the front portion has a D-SUB polarizing structure.

5. The insulator of claim 4, wherein the contact holes receive dual wiped contacts.

6. The insulator of claim 5 wherein the dual wiped contacts inserted in the contact holes are sub-flushed approximately 0.020 inches from the front face.

7. The insulator of claim 5, wherein the contacts holes are defined by a tulip channel that extends backward from the front face, and a ramped channel that abuts the tulip channel and extends backward to the back face.

8. The insulator of claim 7, wherein the top and bottom surface of the insulator gradually extends toward the housing from the front face.

9. The pin connector of claim 8 wherein the insulator is molded plastic and the housing is die cast metal.

10. The pin connector of claim 9, wherein the pin connector is a 9 pin D-SUB connector that mounts to the PCB contained within a Gigabit Link Module.

11. A 9 pin D-SUB connector for use with a Gigabit Link Module, where the pin connector comprises:

a unitary insulator inserted within a unitary housing, the insulator having a front and back face and a top and bottom surface, and the housing having a front and back end and a top and bottom cover;

the insulator having an intermediate PCB slot open at the back face that is engageable with an edge of a PCB, the intermediate PCB slot having a key element received by a notch on the edge of the PCB;

the insulator having a plurality of contact holes extending from the front face to the back face, where each contact hole receives a contact inserted therein; and the housing having an exterior fastener hole extending through the housing at the top cover and aligning with a top fastener hole extending through the insulator from the top surface.

12. The 9 pin D-SUB connector of claim 11, wherein the insulator is formed from molded plastic and the housing is formed from die cast metal.

13. The 9 pin D-SUB connector of claim 11, wherein the housing includes at least one alignment ribs extending forward from the back end and along an interior surface of the top cover, wherein the alignment ribs protrude to and frictionally retain the insulator within the housing.

14. The 9 pin D-SUB connector of claim 13, wherein the alignment ribs include wedged end pieces in proximity to the back end of the housing.

15. The 9 pin D-SUB connector of claim 14, wherein the top and bottom surface of the insulator gradually extends toward the housing from the front face.

16. The 9 pin D-SUB connector of claim 15, wherein the contacts holes are defined by a tulip channel that extends backward from the front face, and a ramped channel that abuts the tulip channel and extends backward to the back face.

17. The 9 pin D-SUB connector of claim 16, wherein the contacts inserted within the contact holes are dual-wiped contacts.

18. The 9 pin D-SUB connector of claim 17, wherein the insulator contains contacts within the contact holes that are sub-flushed approximately 0.020 inches relative to the front face.

19. The 9 pin D-SUB connector of claim 18, wherein the fastener is a self-tapping screw.

20. A 9 pin D-SUB connector for use with a Gigabit Link Module, where the pin connector comprises:

a unitary molded plastic insulator inserted within a unitary die cast metal housing, the insulator having a front and back face, and the housing having a front and back end;

the insulator including a D-shaped front portion extending backwards from the front face, and a rectangular back portion extending forward from the back face that merges with the front portion;

the insulator having a plurality of contact holes extending from the front face to the back face, the contact holes integrally formed from a tulip channel extending backwards from the front face and merging with a ramped channel that extends to the back face;

the insulator having an intermediate PCB slot open at the back face that receives the edge of a PCB, the intermediate PCB slot including a key element that is mated with a notch on the edge of the PCB;

the housing having a top and bottom cover that extend from the front end to the back end, with at least one exterior fastener hole contained within the top cover that accesses the insulator;

the insulator having a top and bottom surface that extend from the front face to the back face;

the top surface containing at least one top fastener hole that aligns with the exterior fastener hole and accesses the PCB the intermediate PCB slot to the exterior fastener hole;

a fastener extended through the housing via the exterior and top fastener hole to securely engage the PCB inserted in the intermediate PCB slot; and at least one alignment rib extending along an interior side of the top segment and frictionally retaining the insulator inserted within the housing.

21. The 9 pin D-SUB connector of claim 20, wherein the alignment ribs have wedged end pieces in proximity to the back end of the housing.

22. A method for assembling a 9 pin D-SUB connector for use with a Gigabit Link Module, comprising the steps of:

loading a plurality of contacts tail-first into a plurality of contact holes in a front face of a unitary insulator, the insulator having a back face opposing the front face, a top surface opposing a bottom surface, and a first and second side wall that oppose one another, with an intermediate PCB slot open at the back face and extending from the first side wall towards the second side wall;

extending the contacts through the insulator and beyond the back face;

loading the front face of the insulator into a back end of a housing, the housing having a front end opposing the back end, a top cover, and an open area contained within the front end that accesses the front face of the insulator and contacts contained therein to another connector;

inserting a PCB into the intermediate PCB slot of the insulator including the sub-step of mating a key element contained within the intermediate PCB slot with a corresponding notch on the PCB;

inserting at least one fastener through the housing, insulator and PCB, the fastener being inserted from the top segment of the housing through the bottom surface of the insulator; and electrically contacting the contacts extending from the back face of the insulator with the PCB.

23. The method of claim 22, wherein the step of loading a plurality of contacts includes loading nine contacts into nine contact holes respectively.

24. The method of claim 23, wherein the step of inserting at least one fastener includes inserting at least one self-tapping screw.

25. The method of claim 24, wherein the step of loading the insulator includes frictionally retaining the insulator by at least one alignment rib extending along an interior side of the top covers and protruding to the insulator.

26. The method of claim 25, wherein the step of loading the insulator includes gradually extending the top and bottom surface of the insulator towards the housing to frictionally engage the housing.

* * * * *